US007916015B1

(12) United States Patent
Evancich et al.

(10) Patent No.: US 7,916,015 B1
(45) Date of Patent: Mar. 29, 2011

(54) SYSTEM AND METHOD FOR MONITORING ENVIRONMENTAL CONDITIONS

(75) Inventors: Nicholas H. Evancich, Columbia, MD (US); Michael P. McLoughlin, Sykesville, MD (US); Keith A. Soldavin, Laurel, MD (US); Micah A. Carlson, Arnold, MD (US); Gerad D. House, Columbia, MD (US); Marshall J. Jose, New Windsor, MD (US); Edward P. Rhyne, Columbia, MD (US); Charles W. Kerechanin, II, Burtonsville, MD (US); Henry A. Kues, Jr., Eldersburg, MD (US); Eric J. Van Gieson, Millersville, MD (US)

(73) Assignee: The Johns Hopkins University, Baltimore, MD (US)

( * ) Notice: Subject to any disclaimer, the term of this patent is extended or adjusted under 35 U.S.C. 154(b) by 1702 days.

(21) Appl. No.: 11/089,823

(22) Filed: Mar. 25, 2005

Related U.S. Application Data

(60) Provisional application No. 60/556,392, filed on Mar. 25, 2004.

(51) Int. Cl.
*G08B 1/08* (2006.01)

(52) U.S. Cl. ..... 340/539.26; 340/521; 340/539.11

(58) Field of Classification Search ..... 340/539.22, 340/539.26, 539.1, 521, 540, 539.11
See application file for complete search history.

(56) References Cited

U.S. PATENT DOCUMENTS

| | | | | |
|---|---|---|---|---|
| 4,709,265 | A * | 11/1987 | Silverman et al. | 348/158 |
| 6,418,324 | B1 | 7/2002 | Doviak et al. | |
| 6,526,807 | B1 | 3/2003 | Doumit et al. | |
| 6,558,320 | B1 | 5/2003 | Causey, III et al. | |
| 6,559,769 | B2 | 5/2003 | Anthony et al. | |
| 6,602,191 | B2 | 8/2003 | Quy | |
| 6,605,038 | B1 | 8/2003 | Teller et al. | |
| 6,640,145 | B2 | 10/2003 | Hoffberg et al. | |
| 6,642,855 | B2 | 11/2003 | Budnovitch | |
| 6,919,803 | B2 * | 7/2005 | Breed | 340/539.14 |
| 7,119,676 | B1 * | 10/2006 | Silverstrim et al. | 340/531 |
| 7,394,363 | B1 * | 7/2008 | Ghahramani | 340/539.22 |
| 7,656,293 | B2 * | 2/2010 | Fong et al. | 340/539.18 |

* cited by examiner

*Primary Examiner* — Davetta W Goins
(74) *Attorney, Agent, or Firm* — Albert J. Fasulo, II

(57) ABSTRACT

A monitoring system and method for detecting environmental conditions is provided, the monitoring system including a sensing unit including a plurality of sensors for obtaining data related to environmental conditions, a controller interfaced with the sensing unit for receiving and encoding the data related to environmental conditions into a predetermined format using a base64 encoding scheme, and a communication device for receiving the data in the predetermined format from the controller, forming an e-mail message (which can be further encoded) including instructions on how to decode the email message and transmitting the e-mail message including the data in the predetermined format to at least one predetermined recipient.

28 Claims, 10 Drawing Sheets

| 802 IMS TECHNOLOGY (LCD3) | 804 SAW TECHNOLOGY (HAZMATCAD) | 806 PID TECHNOLOGY (MULTIRAE+) | 808 RADIATION (HRM) | 810 ACTION TAKEN |
|---|---|---|---|---|
| G AGENT DETECTION | | | | NONE |
| | G AGENT DETECTION | | | NONE |
| G AGENT DETECTION | G AGENT DETECTION | | | IMMEDIATELY SOUNDS ALARM, SENDS EMAIL AND STARTS SORBENT PUMP |
| H AGENT DETECTION | | | | NONE |
| | H AGENT DETECTION | | | NONE |
| H AGENT DETECTION | H AGENT DETECTION | | | IMMEDIATELY SOUNDS ALARM, SENDS EMAIL AND STARTS SORBENT PUMP |
| HCN AGENT DETECTION | | | | NONE |
| | | HCN AGENT DETECTION | | NONE |
| HCNDETECTION | | HCNDETECTION | | IMMDEDIATELY SOUNDS ALARM, SENDS EMAIL AND STARTS SORBENT PUMP |
| LEWISITE | | | | AFTER 20 SECONDS, SOUNDS ALARM, SENDS EMAIL, STARTS SORBENT TUBE COLLECTION |
| | | VOC, $PH_3$ | | AFTER 20 SECONDS, SOUNDS ALARM, SENDS EMAIL, STARTS SORBENT TUBE COLLECTION |
| CK | | | | AFTER 20 SECONDS, SOUNDS ALARM, SENDS EMAIL, STARTS SORBENT PUMP |
| | | EXPLOSIVE ATMOSPHERE (LEL) OR LOW $O_2$ | | SOUNDS ALARM IMMEDIATELY,SENDS EMAIL AFTER 20 SECONDS |
| | | | READING OF ≥ 7 FOR GAMMA OR NEUTRONS | AFTER 60 SECONDS SOUNDS ALARM, SEND EMAIL |

FIG. 8

SYSTEM AND METHOD FOR MONITORING ENVIRONMENTAL CONDITIONS

CROSS-REFERENCE TO RELATED APPLICATIONS

This application claims the benefit of prior filed U.S. Provisional Application No. 60/556,392, filed Mar. 25, 2004, the contents of which are incorporated herein by reference.

STATEMENT OF GOVERNMENTAL INTEREST

This invention was made with Government support under Contract No. N00024-03-D-6606, awarded by the Naval Sea Systems Command (NAVSEA). The Government has certain rights in the invention.

BACKGROUND OF THE INVENTION

1. Field of the Invention

The present invention relates generally to a system and method for monitoring various environmental conditions.

2. Description of the Related Art

Under the current heightened level of alert due to the serious threat of terrorist attack against the United States, various govemmental and private security agencies now employ systems and devices to monitor the environment for the presence of hazardous chemicals, biological agents and radioactive substances. Because such systems and devices must be very sensitive to the presence of these agents, false alarms can be a common occurrence. Moreover, because these hazardous agents may be widely dispersed, many sensing devices are necessary to provide the required coverage. Additionally, conventional sensors and systems for detecting these agents can be prohibitively expensive.

False alarms can create an uncertain situation for hazardous materials (HAZMAT) operators, thus inhibiting their performance and their decision-making processes. Accordingly, a significant need exists to reduce the number of false alarms that typically occur when using a single technology to detect the presence of chemical warfare agents (CWA's).

Wireless technologies have become more and more popular recently. For example, wireless Internet and cell phones have already taken a huge portion of the market share away from wired Internet and telephone lines. As people are more open to wireless technologies because of increased convenience and information security, companies introduce novel wireless technologies and specific areas of applications. One of the most popular wireless technologies presently in use is the Blackberry™ (hereinafter Blackberry) manufactured by Research in Motion Limited (RIM), Ontario, Canada. The Blackberry supports a variety of functions that are popular among professionals—such as e-mail, cell phone, browser and organizer. Moreover, as the Blackberry uses existing cellular communication networks for communication, it has a vast area-of-service capability.

Blackberry is an end-to-end wireless connectivity option. The Blackberry is unique because it is a single integrated device which allows users to easily send e-mails. Additionally, unlike the traditional way of connecting to an e-mail server to check emails, the Blackberry's "push" technology will automatically direct e-mails to the user's Blackberry device and notify the user when a message is received.

Blackberry devices support a wide range of networks. For example, in the United States, Blackberry supports CDMA2000 1X Networks, DataTAC™ Networks, Global System for Mobile communications/General Packet Radio Service (GSM/GPRS) Networks, Mike Networks, Mobitex, and Nextel Networks. Outside the United States, the Blackberry operates on more than 50 networks in more than 30 countries.

The Blackberry is not only a convenient device for individual users, it also provides a mobile communication solution for corporations and government organizations. The Blackberry is especially useful for transmitting time-sensitive data and information. For example, out-of-office salesmen can receive customer information immediately rather than go back to the office and check e-mail.

A block diagram illustrating conventional Blackberry architecture is shown in FIG. 1. The Blackberry communication system includes a Blackberry wireless handheld device 100 which communicates with a wireless network 102. The wireless network is connected to a corporate firewall 104. The corporate firewall 104 is connected to a Blackberry enterprise server 106. The Blackberry enterprise server 106 is then connected to a corporate e-mail server 108 and to a corporate application and content servers 110. Thus, it is seen that the Blackberry is popular because of its vast range of service, its convenience, low-cost and its capabilities. Moreover, the Blackberry is also government-issue communication device for many government agencies.

Accordingly, under current conditions where there is a threat of terrorism using biological, chemical, nuclear and/or other agents against the United States and other countries, agent detection equipment and methods using the Blackberry and Blackberry-type devices for communication may provide a low-cost, scalable, accurate and easy-to-implement solution for identifying dangerous agents and reporting the results to one or more recipients and for allowing the control of mitigating and warning devices.

SUMMARY OF THE INVENTION

It is, therefore, a feature of the present invention to provide a system and method for monitoring various environmental conditions and for transmitting coded information about those conditions and for controlling devices to respond to those conditions using a communication device such as, for example, a Blackberry or Blackberry-type communication device.

It is another feature of the present invention to provide a small-sized, low-power, low-cost environmental monitoring/control system which uses a communication device (e.g., a Blackberry 950 communication device) that is compatible with wireless e-mail systems, and extensible to controlling environmental control systems (e.g., in buildings and other locations), and that can be made secure using multiple encryption schemes to the text of e-mails.

It is a further feature of the present invention to provide an environmental monitoring/control system which uses base64 encoding of data for transmission by a communication device (e.g., a Blackberry), which spoofs the communication device so that the communication device determines that a data file such as, for example, a JPEG picture file, is a standard text e-mail. This process uses the communication device as a data pipe to exfiltrate data.

It is another feature of the present invention to use a Blackberry communication device to exfiltrate data thereby standardizing the communication and processing interfaces.

It is yet another feature of the present invention to provide a mobile monitoring system and method for detecting environmental conditions, the mobile monitoring system and method including a sensing unit having a sensing unit for obtaining data related to environmental conditions, the sensing unit including at least one radiation sensor and at least one of an electro-optical (EO) imager and a plurality of orthogonal chemical sensors for acquiring a similar data product using dissimilar means, a controller interfaced with the sensing unit for receiving and encoding the data related to environmental conditions into a predetermined format, and a communication device for receiving the data in a predetermined format from the controller, forming an e-mail message and transmitting the e-mail message including the data in a predetermined format to at least one predetermined recipient. The mobile monitoring system and method further includes a receiver for receiving e-mails containing queries, instructions and/or commands from a control station and/or a user and transmitting the received e-mails to the controller for further processing.

It is still yet a further feature of the present invention to provide at least one sensing unit having a plurality of sensors including a chemical sensor, a biological sensor, a radiation sensor and/or an imager for detecting powders, explosives, nerve agents (e.g., VX gas, sarin, etc.), blister agents (e.g., mustard gas), chemical agents, biological agents (e.g., anthrax), radioactive elements and/or images (e.g., photographic images). It is a further object of the present invention to provide at least one air pump activated by a controller, the air pump being used for moving air through both a manifold and a sorbent tube, the manifold being interfaced with at least one or more sensors for providing air flow to the sensors with which the manifold is attached. In alternative embodiments, two air pumps are provided, each air pump being interfaced with the manifold for providing air flow to at least one of the sensors.

It is yet another feature of the present invention to provide at least two sensors which are orthogonal to each other and the outputs of the sensors are weighted so as to minimize false alerts.

It is another feature of the present invention to provide an EO imager including a visible light imager, an infra-red (IR) imager, a ultra-violet (UV) imager and/or an X-ray imager.

It is still yet a further feature of the present invention to implement a base64 encoding scheme for encoding the data related to environmental conditions, alerts, actions, triggers, results of the processing of the data and/or for providing images for transmission using ASCII data. It is a further feature of the present invention to provide information on decoding and assembling encoded data within the encoded data. It is yet another object of the present invention to provide a pearl-script within an encoded e-mail for providing recipients with the option to interact with the environmental monitoring/control system of the present invention.

It is yet another feature of the present invention to provide a method for detecting environmental conditions using a wireless device, the method including obtaining orthogonal data related to environmental conditions and encoding the data related to environmental conditions and/or one or more images into a predetermined format using a base64 encoding scheme, forming an e-mail message having a subject line and a body, the e-mail message including the data related to environmental conditions and/or images, and transmitting the e-mail message including the data in a predetermined format to at least one predetermined recipient. The e-mail message further includes information on how to decode and assemble the encoded data. The method further includes the step of receiving at least one of a command and a query and providing the received command and/or query to a controller for processing.

BRIEF DESCRIPTION OF THE DRAWINGS

The above and other objects, features and advantages of the present invention will become more apparent from the following detailed description when taken in conjunction with the accompanying drawings, in which:

FIG. 8 is a table illustrating exemplary rules for reporting detections by a sensor ensemble (SE);

DESCRIPTION OF THE PREFERRED EMBODIMENTS

The following detailed description of the preferred embodiments of the present invention will be made with reference to the accompanying drawings. In describing the invention, explanations about related functions or constructions which are known in the art will be omitted for the sake of clarity in understanding the concept of the invention.

Figure 1:
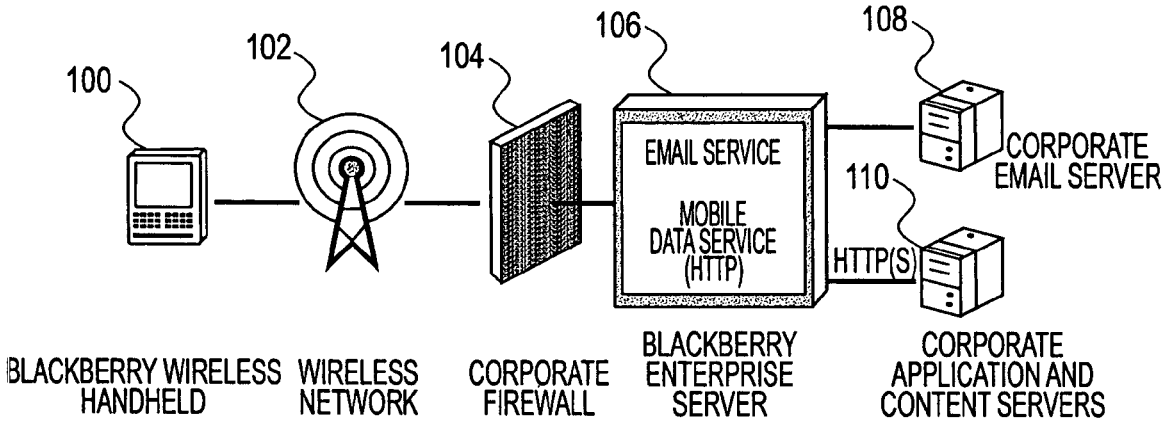
FIG. 1 PRIOR ART
FIG. 1 a block diagram illustrating a conventional Blackberry architecture.
Figure 2:
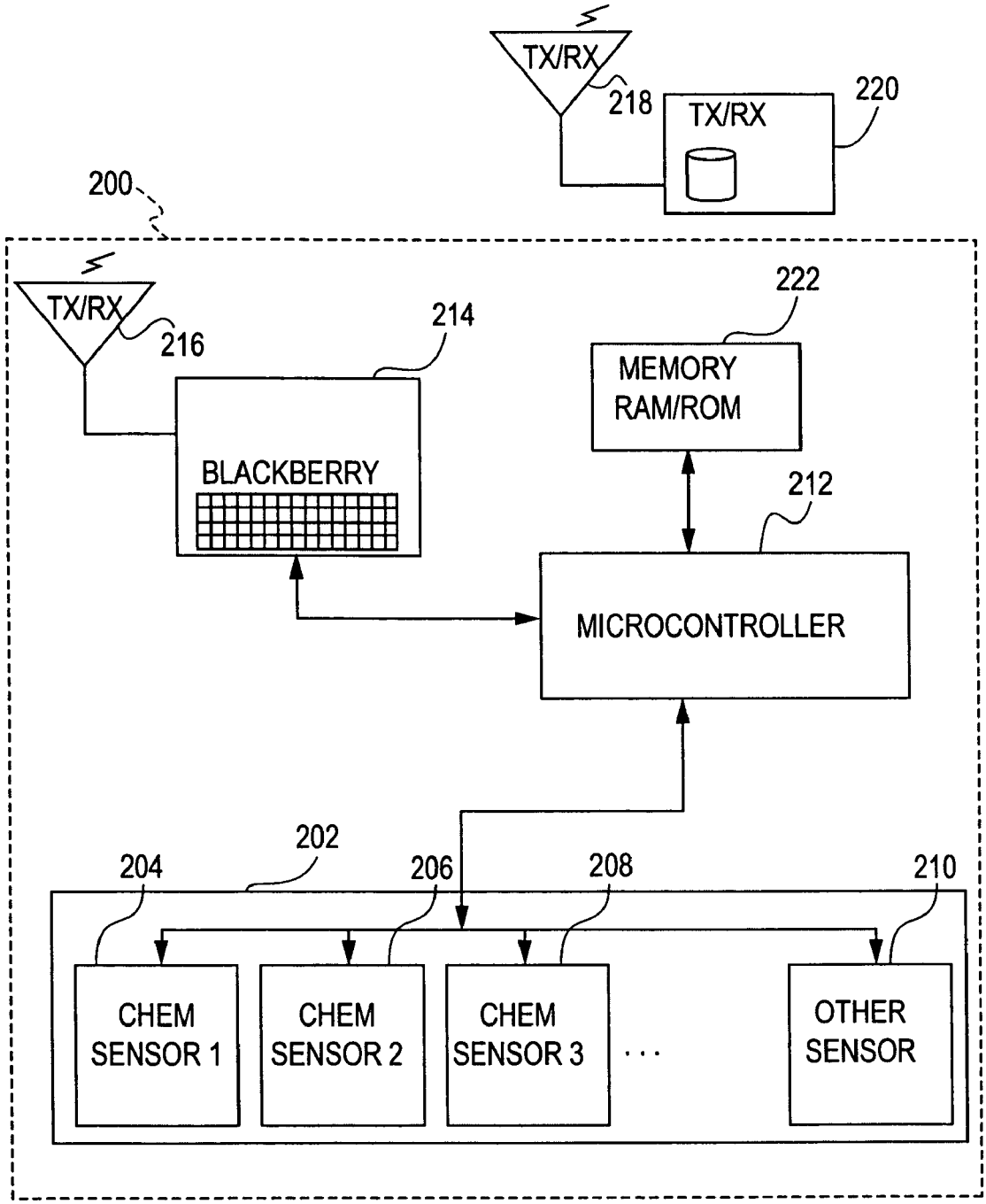
FIG. 2 is a block diagram illustrating a basic configuration of a system for monitoring environmental conditions according to a first embodiment of the present invention.

A block diagram illustrating the basic configuration of a system for monitoring environmental conditions including a sensor ensemble (SE) according to a first embodiment of the present invention is shown in FIG. 2. The SE 200 includes a sensor unit 202, a microprocessor 212, memory 222 (e.g., RAM, ROM, etc.), a communication device (e.g., a Blackberry or other equivalent unit for sending and receiving e-mails) 214, and an antenna 216. The sensor unit 202 includes a first chemical sensor 204, a second chemical sensor 206, a third chemical sensor 208, and a fourth sensor 210. The sensors 204 through 210 are preferably orthogonal to each other (as will be described hereinbelow). Moreover, in preferred embodiments, the sensors 204 through 210 can simultaneously detect and sample blood, blister and nerve agents. The sensor unit 202 communicates with the microprocessor 212 and transmits data relating to the presence and/or absence of various agents to the microprocessor. The microprocessor 212 reads the data from the sensors and formats the data according to the content of the data and forwards the formatted data after base64 encoding (which can include both raw and processed data) to the communication device 214 which assembles the formatted data into an e-mail of a desired format (e.g., including a one or more recipients, a subject line, and a body).

The subject line and the recipients are selected by the microprocessor 212 according to predetermined conditions. For example, if a triggering event meets or exceeds a predetermined threshold (e.g., a threshold corresponding to a major event), the recipients of an alerting e-mail (e.g., majors, generals, etc.) can be chosen accordingly. On the other hand, if a triggering event only meets or exceeds a minor threshold (e.g., a threshold corresponding to a minor event such as a slight increase in background radiation which could be caused by an individual with implanted radioactive seeds to treat a cancerous condition), then only local police officers/guards would be alerted. The one or more e-mails containing the data from the sensing unit 202 are transmitted to desired recipients (not shown) via a serving base station (not shown) and a wired e-mail server which transmits the e-mail over normal protocols that govern Internet (and other) e-mail. Users of this system can communicate with the communication device 214 to query the status, adjust the system's parameters and/or request a service by sending a formatted e-mail to the communication device 214. A microprocessor on the communication device 214 then processes data contained in the received e-mail and optionally controls the sensors and/or optional relays. Alternatively, after the e-mail is initially processed by the communication device, data contained in the received e-mail is forwarded to the microprocessor 212 which further processes the received data and responds accordingly (e.g., by adjusting the sensors within sensor unit 202, responding to system "pings" etc.). Formatted e-mails are forwarded to the communication device 214 via the Internet or other network, a serving base station (not shown), and the antenna 216. The received messages are then processed and stored by either or both the communication device 214 and the microprocessor 212 and desired actions (e.g., wireless transmission to a recipient) are then taken (as will be described below). For example, a formatted e-mail is transmitted from the transmit/receive antenna 216 to a control center 220 (or to one or more e-mail servers (not shown)) via its transmit/receive antenna 218.

Figure 3:
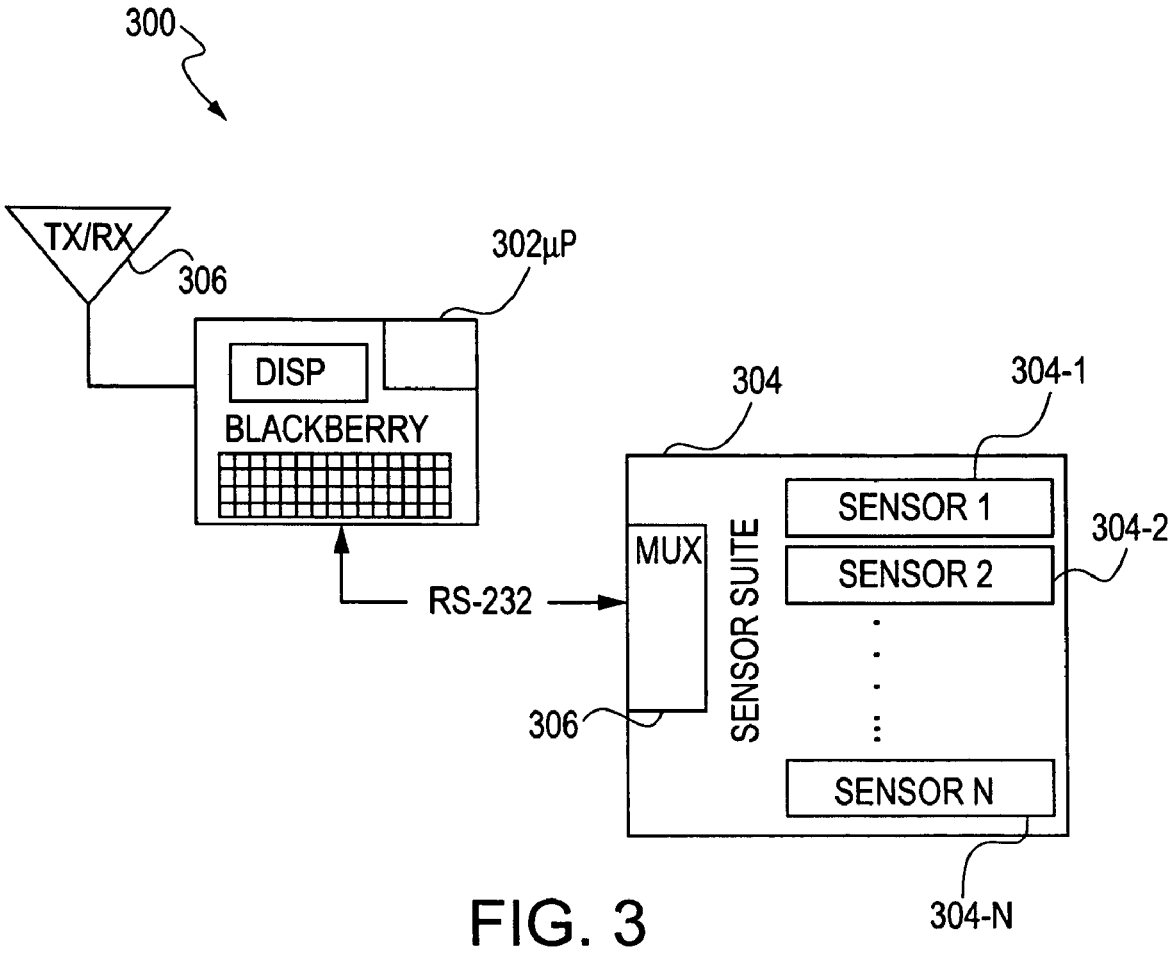
FIG. 3 is a block diagram illustrating a system for monitoring environmental conditions according to a second embodiment of the present invention.

A block diagram illustrating the system for monitoring environmental conditions according to a second embodiment of the present invention is shown in FIG. 3. In this embodiment, the SE 300 comprises a communication device 302 (e.g., a Blackberry as shown) which includes an integrated microprocessor 302μP, a plurality of orthogonal sensors 304, a mux 306 and an antenna 306. The SE 300 operates similarly to the SE 200 described above with a difference being the use of the Blackberry's internal microprocessor 212 rather than the use of separate microprocessor (e.g., microprocessor 302μP as shown in FIG. 2) to read data, process and encode data and otherwise control the sensors as shown in the embodiment illustrated in FIG. 2. Another difference is the use of the mux 306 for inputting/outputting data and control commands to/from sensors and the communication device 302. Accordingly, for the sake of clarity, no further description of the operation of the SE 300 will be given.

Figure 4:
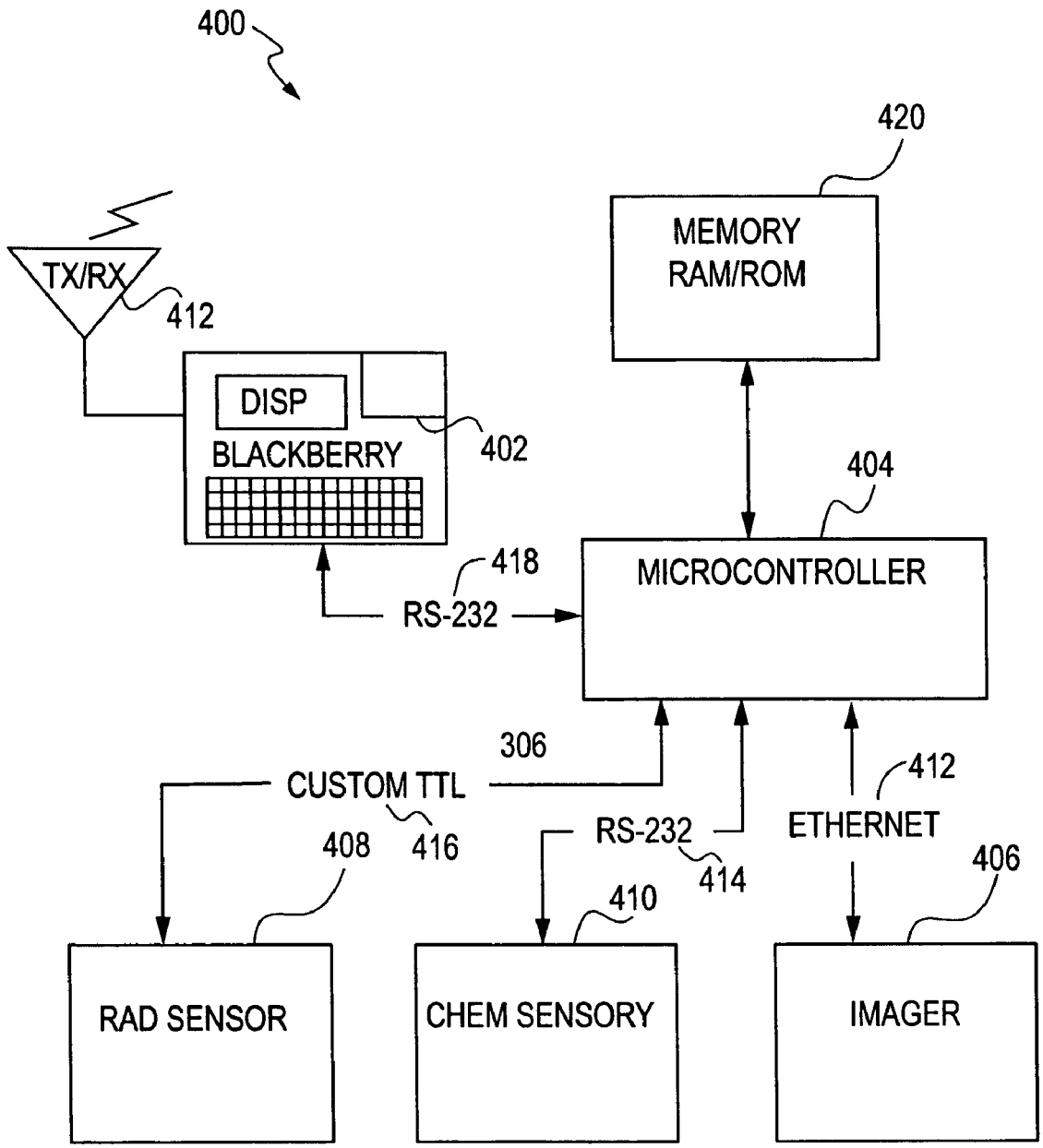
FIG. 4 is a block diagram illustrating a system for monitoring environmental conditions according to a third embodiment of the present invention.

A block diagram illustrating the system for monitoring environmental conditions according to a third embodiment of the present invention is shown in FIG. 4. This embodiment is similar to the first embodiment of the present invention in that an optional microcontroller 404 is interfaced to a communication device 402 via an RS-232 interface 418. This embodiment demonstrates exemplary interfaces which can be used to communicate between the various units of the present invention. The microcontroller 404 interfaces with a radiation sensing unit 408 via a custom transistor-transistor logic (TTL) interface 416, a chemical sensing unit 410 via an RS-232 interface 414 (which can be the same as RS-232 418), and with an imager 406 (including, e.g., a camera, etc. as necessary) via an Ethernet interface 412. Memory 420 includes a RAM and ROM and interfaces with the microcontroller 404.

Figure 5:
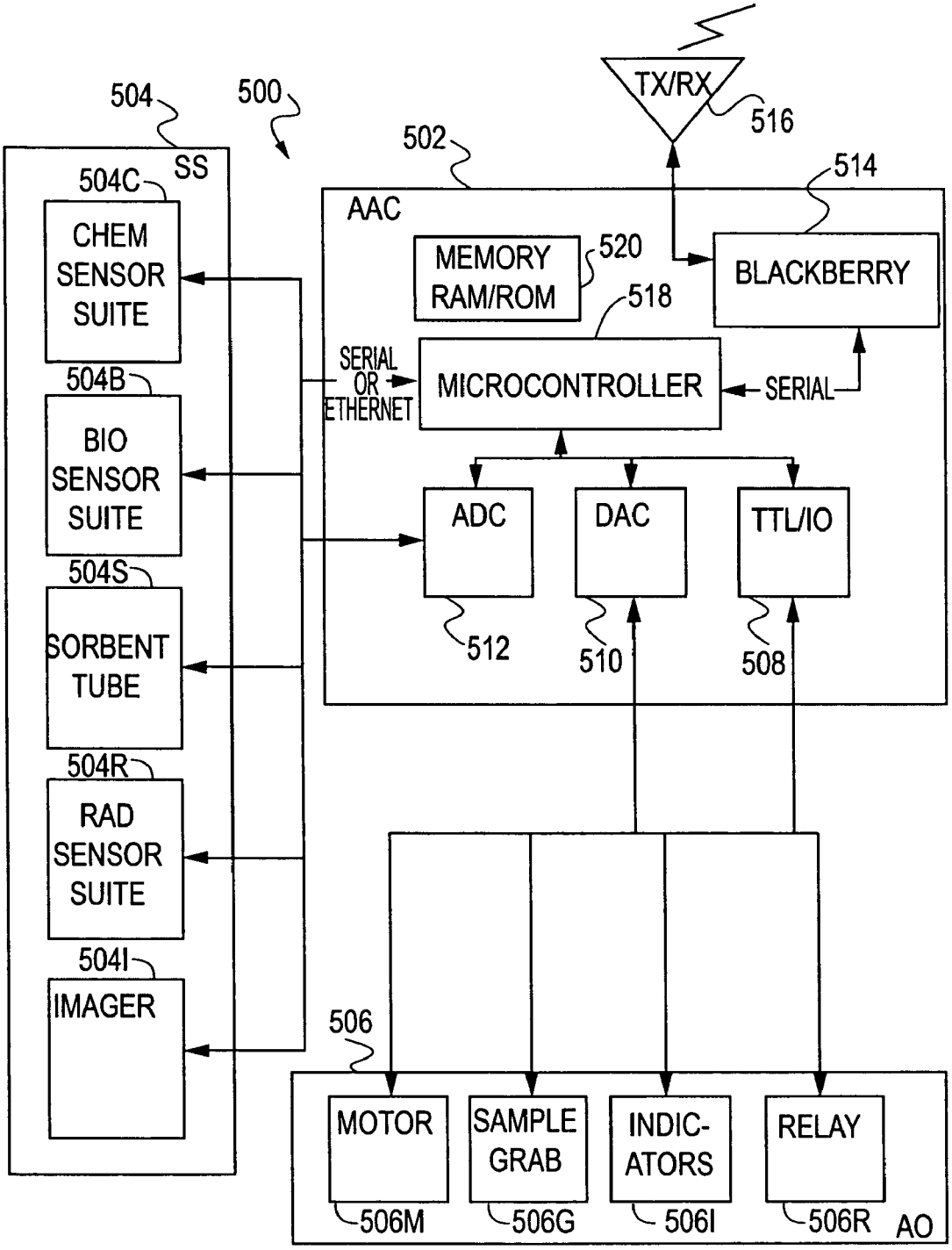
FIG. 5 is a block diagram illustrating a system for monitoring environmental conditions according to a fourth embodiment of the present invention.

A block diagram illustrating the system for monitoring environmental conditions according to a fourth embodiment of the present invention is shown in FIG. 5. As shown, the SE 500 according to the present embodiment is split into three subsystems including an algorithms and communications subsystem (AaC) 502, a sensors subsystem (SS) 504 and an actions outputs (AO) subsystem 506. The SS 504 includes a chemical sensor suite 504C, a biological sensor suite 504B, a radiation sensor suite 504R, an imager (e.g., a camera) 504I and a sorbent tube 504S. The chemical sensor suite 504C, the biological sensor suite 504B, the radiation sensor suite 504R, the sorbent tube 504S and the imager 504I can include one or more sensors (or other means) for detecting various agents as desired. The AaC subsystem 502 includes a microcontroller 518, memory (e.g., RAM, ROM, Etc.) 520, a communication device (e.g., a Blackberry device) 514, an analog-to-digital converter (ADC) 512, a digital-to-analog converter (DAC) 510 and a transistor-to-transistor (TTL) input/output (I/O) device 508. The microcontroller 518 interfaces with the SS 504 using a serial and/or an Ethernet connection, and the microcontroller 518 interfaces with the communication device 514 using a serial connection such as an RS 232-type connection. The memory 520 provides initialization commands (e.g., initialization strings, etc.) to the microcontroller 518 and is also used to store data for later use. A manifold (not shown) interfaces with the sorbent tube 504S, the chemical suite 504C, and/or the biological suite 504B so as to provide air flow to the respective suite. One or more optional pumps (not shown) are powered by the motor 506M (which can include a plurality of motors).

In operation, the AaC 502 reads outputs from the SS 504 (and can optionally act upon the SS 504 for example by calibrating the sensors, turning the sensors on/off etc. as desired) in order to wrap or merge the data received from the SS 504 into a meta-datagram, which is transmitted via the communication device 514 (i.e., the communication pipe). The communication device 514 can communicate using traditional communication schemes including IEEE 802.11, Bluetooth, Ethernet, etc. as desired. The system 500 can also accept commands and queries from the communication pipe by way of messages which are sent to the system 500 from an external source (e.g., a user, a control center, etc). The messages can be used to affect the subsystems SS, AO and AaC, 504, 506 and 502, respectively. The SS 504 interfaces with the AaC 502 using various communication protocols including Serial (e.g., RS-232, RS-422), Ethernet, WiFi and Custom (e.g., SPI, direct sensing of the ADC, etc.).

In operation, the microcontroller 518 manages the configuration, control and flow of data and commands to/from the SS 504. The microcontroller 518 also runs algorithms and determines if the current sample meets certain requirements such as to trigger an alarm condition. Moreover, if an alarm condition is detected, then an e-mail message can be generated and transmitted via the communication device 514. The communication device 514 can optionally send a message to the microcontroller 518 to affect the SS 504 or other systems by, for example, changing system parameters. For example, when the radiation sensor suite 504R is triggered, the AaC 502 reads the information it has received and determines whether the trigger meets a preset threshold (e.g., radiation threshold). If the AaC 502 determines that the trigger it has received meets or exceeds a preset threshold, the AaC 502 can then trigger the imager 504I to capture an image of an actor (e.g., an individual, a vehicle, an object such as a container, a rock, etc.) which caused radiation suite 504R to trigger and/or trigger the relay 506R, the motor 506M and/or the indicators 5061 to control desired systems. For example, if a radiation sensor in the radiation sensor suite 504R is triggered, the microcontroller 518 can configure an e-mail to warn of the threat. Moreover, the microcontroller 518 can then send an image of the actor which caused the triggering event and trigger the motor 504M to stop/start ventilation in a building and/or to take environmental samples. Additionally, the relay 506R can be triggered to open/close doors and indicators 5061 can be triggered to warn individuals of possible danger, etc. Moreover, the microcontroller 518 can activate the sorbent tube 504S if predetermined conditions are met or if activated by an external source (e.g., the control center, the user, etc.).

The sensors in each suite (e.g., the chemical sensor suite 504C, the biological sensor suite 504B and/or the radiation sensor suite 504R) are preferably orthogonal to each other and/or to other suites. Moreover, in one embodiment there can be up to 256 suite packages (of any combination).

The controller also can take an output from multiple, orthogonal chemical sensors (included in a chemical suite 504C) and determine whether to trigger an alarm (e.g., by sending an e-mail). The algorithm used by the microcontroller allows for weighting of each sensor, and thus can account for different sensitivities such as response time, accuracy, etc., to minimize false alarms. The system 500 can also accept the input from an additional RS-232, Ethernet or custom user interface.

In a preferred embodiment the SS 504 and the AO 506 are configured for specific applications, and the AaC 502 can be common to all applications, which can result in significant cost reduction and reduced system complexity.

Figure 6:
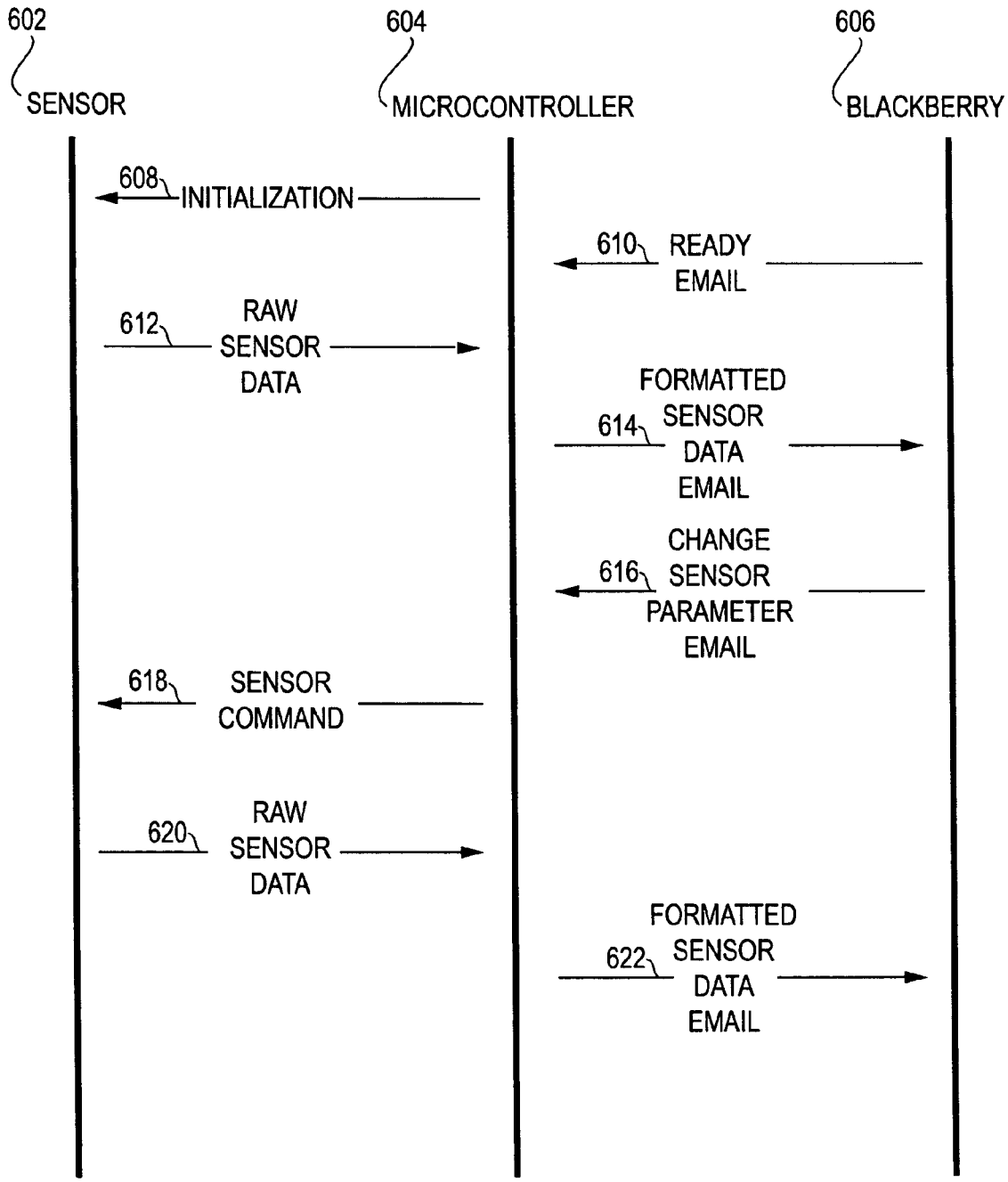
FIG. 6 is a block diagram illustrating the data flow process according to an embodiment of the present invention.

A flow diagram illustrating the data flow process according to an embodiment of the present invention is shown in FIG. 6. In step 608, a microcontroller 604 initializes sensors 602. In step 610, the microcontroller 604 then prepares a "Ready E-mail" for transmission by a communication device (e.g., a Blackberry) 606 to desired recipients. The "Ready E-mail" can include an SE identification, the location of the SE, the number and/or types of sensors included in the SE, etc. The communication device 606 then transmits the Ready E-mail. The microcontroller 604 then reads the sensors data 602 in step 612. In operation, the microcontroller 604 weighs the inputs from a plurality of sensors (with at least two of the sensors being orthogonal to each other) 602 with, for example, the more sensitive sensors being given more weight. Additionally, the microcontroller 604 can affect the settings of one or more sensors in order to yield the best set of data. After the microcontroller 604 reads and/or processes the sensors' data 602, the results are formatted into one or more messages depending upon the content. For example, ASCII data is formatted into a standard e-mail message that contains the sensor data (raw), alerts, actions, triggers, and/or the processed results of the sensors' data. The binary ASCII data is then base64 encoded and a message is generated that details how to decode and assemble the data. The base64 encoded data is then input into and transmitted by a communication device (e.g., a Blackberry) 606 in step 614. Each sensor produces at its output a numerical value indicative of the level of whatever it is supposed to sense. The user of the system sets (i) a triggering point for each sensor, e.g., a threshold value of the numerical value above which a positive indication is assumed, and (ii) a duration or time period for which the threshold value is to be met or exceeded. If the output of the sensor exceeds the trigger point for the targeted duration, then the trigger is considered valid and the pre-program action is taken (e.g., send an e-mail to a predetermined email address, sound an alarm, give a visible indication, and so on. If two orthogonal sensors (which are sampling from the same input, e.g., sensing the same thing) give different and incompatible results (e.g., one sensor indicates a first chemical, while the other indicates a second different chemical), then a warning message is generated and sent to the users, e.g., transmitted from the SE to the predetermined e-mail address. The users at this point can remotely command the system (via e-mail from the predetermined e-mail address to the SE) to take action. If two orthogonal sensors (which have different sensitivities, e.g., different thresholds) give the same result (e.g., indicate the same chemical), but before the targeted duration expires the less sensitive sensor drops out (e.g., does not meet its threshold), the system will still trigger and report the condition. On the other hand, if two orthogonal sensors (which have different sensitivities) give the same result (e.g., both meet their thresholds indicating an alarm condition), but before the targeted duration expires the more sensitive sensor drops out, the system will consider this a false trigger.

In a reverse process, the communication device (e.g., a Blackberry) 606 receives a transmitted message and forwards the transmitted message to the microcontroller 604 in step 616. The Microcontroller 604 then processes the received transmitted message and one or more desired actions are taken (e.g., sensors are turned on/off, reset, parameters adjusted, etc. as desired) by sending appropriate commands to the sensors 602 in step 618. In alternative embodiments, data can be sent from the microcontroller 604 to a desired recipient (not shown) using a General Packet Radio Service (GPRS) modem, an Ethernet modem, etc. Raw sensor data is then forwarded from the sensors 602 to the microcontroller 604 in step 620. The microcontroller 604 then processes and encodes the raw sensor data as described above, the binary ASCII data is then base64 encoded and a message is generated that details how to decode and assemble the data. The base64 encoded data is formed into a formatted sensor data e-mail and forwarded to the communication device 606 for transmission to a desired recipient in step 622.

Figure 7:
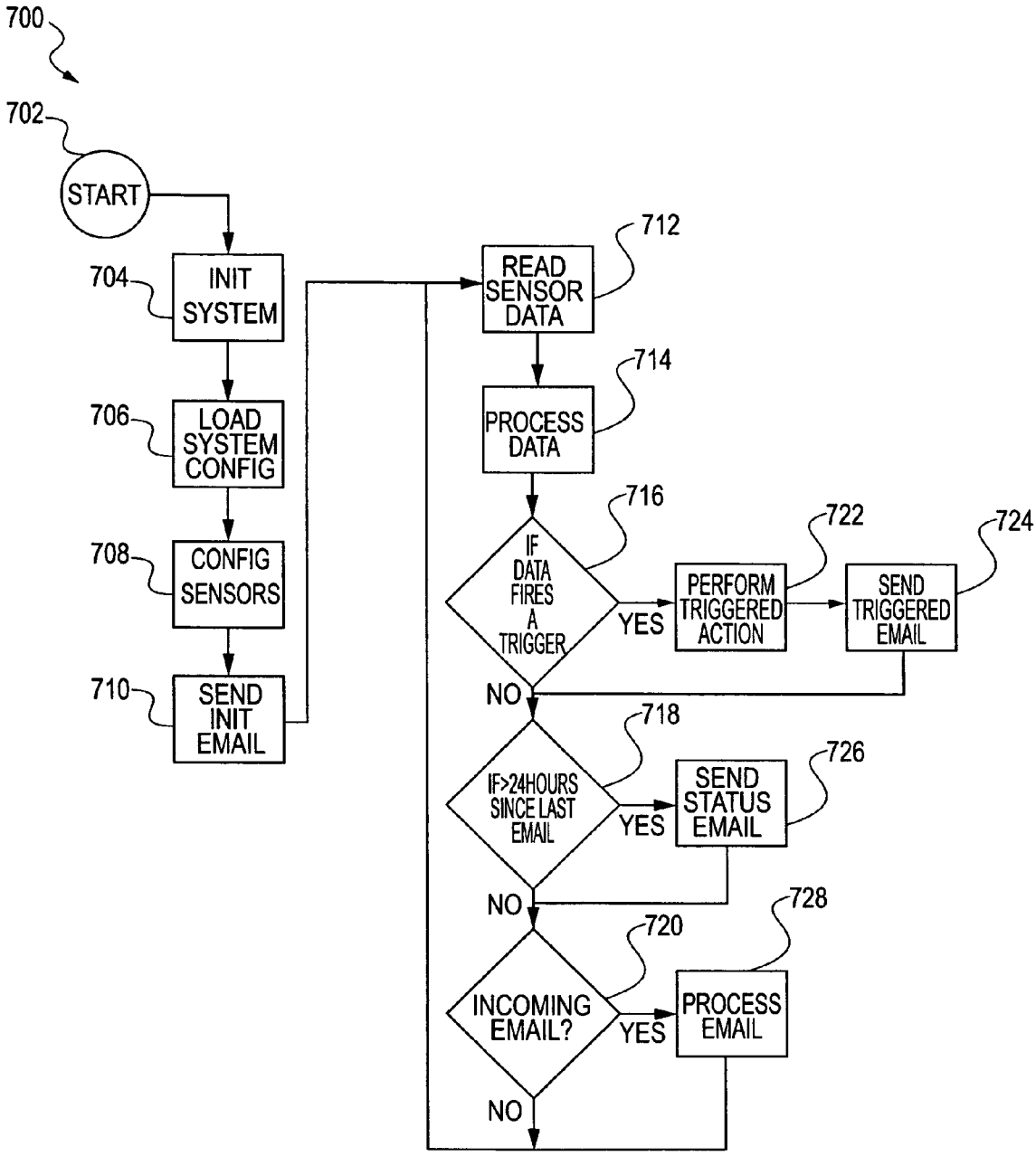
FIG. 7 is a flowchart illustrating the process of collecting, analyzing and transmitting data related to environmental conditions according to an embodiment of the present invention.

A flowchart illustrating the process of collecting, analyzing, processing and transmitting data related to environmental conditions and receiving and processing according to an embodiment of the present invention is shown in FIG. 7. The system 700 is started and initialized in steps 702 and 704, respectively. The system then proceeds to load system configurations and configure sensors in steps 706 and 708, respectively. The system includes a memory (e.g., a RAM, ROM, FLASH, etc.) which maintains initialization routines, etc. which are used at startup and during the initialization process. A suitable memory includes a memory which is integrated with the Blackberry. In step 710 an optional initialization e-mail with a unit identification and optional sensor-type data (e.g., the number and/or type of sensors with which the unit is equipped) is sent to a recipient (e.g., a control center, the user, etc.) by a communication device (e.g., a Blackberry) to inform the recipient that the unit is online. It should also be noted that, in this embodiment, it will be assumed all e-mails are transmitted/received using the Blackberry. The sensor data is then read by a microcontroller and processed in steps 712 and 714, respectively. In step 716, a determination is made whether to fire a trigger based on the results of the sensor data and/or the processing of the sensor data. The appropriate actions to take when firing a trigger can be determined using (for example) a table look-up which contains predetermined thresholds and corresponding actions for alerting (e.g., by sending an e-mail message), sampling and activating/deactivating solenoids, etc.

If it is determined that a trigger should be fired, then step 722 follows. Alternatively, if a determination is made in step 716 not to fire a trigger, then step 718 follows. In step 722 a triggered action (e.g., an appropriate action for the type of triggering event) is performed and an appropriate e-mail (dependent upon the triggering event) to desired recipients (which can also be dependent upon the triggering event, for example, if a biological sensor is triggered the system 700 can send an e-mail message to an appropriate agency such as the Centers for Disease Control (CDC)) is performed in step 724. In step 718, the system determines when the last e-mail was sent (via the Blackberry), and if it is determined that more than a preset amount of time (in this example 24 hours) has elapsed, a status e-mail is sent in step 726. Alternatively, if 24 hours has not elapsed since the last e-mail was sent in step 718, a determination is made as to whether there is any incoming new e-mail in step 720. If it is determined that there is an incoming new e-mail, the incoming new e-mail is processed in step 728. Alternatively, if it is determined in step 720 that there is no new e-mail, sensor data is read in step 712.

A table illustrating exemplary rules for reporting detections by SE instruments is shown in FIG. 8. At the top of the table, ion mobility spectrometer (IMS) technology, surface acoustic wave (SAW) technology, photoionization (PID) technology and Handheld Radiation Monitor (HRM) sensors 802, 804, 806 and 808 are shown. Depending upon the agent detected and the number of sensors detecting the one or more agents, a predetermined action 810 is taken. For example, if Volatile Organic Compounds (VOC) and/or $PH_3$ (Phosphine) is detected by the PID technology sensor 806, then after 20 seconds, the SE sounds an alarm, sends email (including relevant data) and starts sorbents tube (not shown) collection. Alternatively, if an H agent is detected by only one of either the IMS technology sensor 802 or the SAW technology sensor 804, no action is taken. But, if both the IMS technology sensor 802 and the SAW technology sensor detect an H agent, then an action is taken and the SE immediately sounds an alarm, sends e-mail and starts a sorbent pump (not shown). By using orthogonal sensors (i.e., a set of sensors that can acquire a similar data product, e.g., to detect a similar or the same chemical, agent, etc., via dissimilar detection means, e.g., using IMS and SAW technologies) and weighing the results of each of the plurality of sensors, the number of false alarms can be minimized.

The SE of the present invention can maintain an e-mail distribution list for alarm notifications. The SE can then selectively e-mail recipients and send e-mails to one or more recipients depending upon the type of triggering event. For example, if a radiation sensor triggers the SE, then the SE can send an e-mail to a nuclear response team and to other predetermined recipients. Additionally, the SE can vary the repetition rate of e-mails and can send e-mails based on the level that sensors report. For example, if the SE detects low-level radiation, the SE would report it to municipal authorities but if the SE detects extremely high levels of radiation, then the SE would send the warning to a special response team. Additionally, depending upon the e-mail created, the SE can select different e-mail bodies.

For example, to change the communication device's e-mail distribution list for alarm notifications, then a user would send the following e-mail to a SE:

Subject: "email recipients"

Message body: "email=xxx@yyy.zzz"

The communication device can also reply to correctly received e-mails and reply to the sender a confirmation.

Another advantage of the present invention is that a user, e.g., the control station, etc., can "ping" the communication device. When pinged (via e-mail), the communication device can reply using an e-mail with the following subject and message body. Subject: "Ping Response"; Message body: "I'm alive."

The e-mails sent to recipients by the communication device preferably include a script such as a pearl script which would enable the user to respond to the e-mail and/or effect changes to control the SE without having to open other editors, know a programming language, etc. For example, an e-mail including the following subject and body: Subject: Change Address List; Body:password<cr>; xxx@yyy.zzz<cr>xxx1@yyy.zzz . . . would enable the recipient to easily change the address of recipients on an e-mail list by providing a password and the e-mail addresses of one or more desired recipients and returning the e-mail to the sender. This would allow cross-platform functionality.

Figure 9:
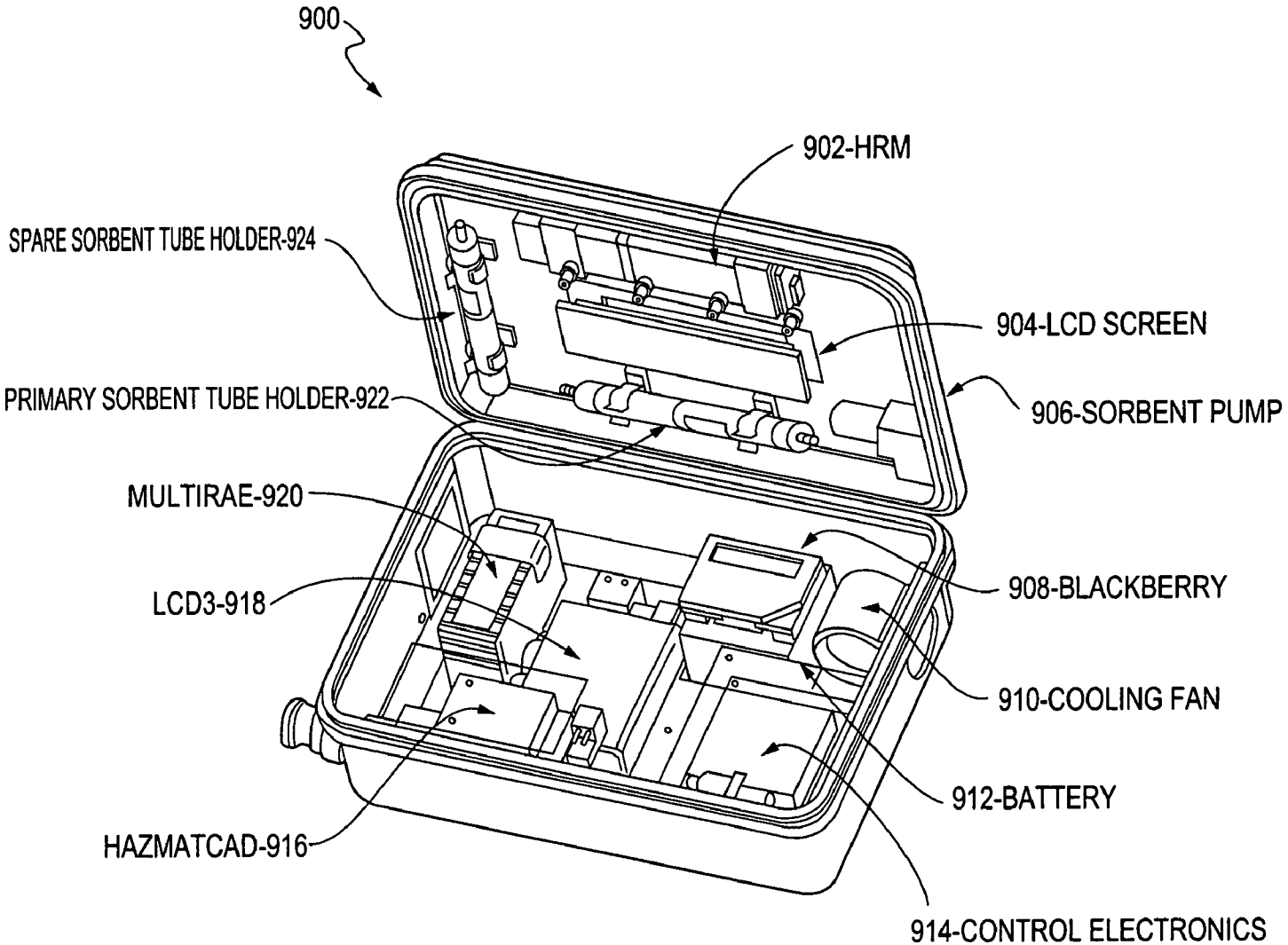
FIG. 9 is a perspective-view illustration of a sensor ensemble (SE) unit according to an embodiment of the present invention.

A perspective-view illustration of a sensor ensemble (SE) unit according to an embodiment of the present invention is shown in FIG. 9. The SE 900 includes an HRM 902 for detecting radiation, an optional liquid crystal display (LCD) display screen 904, a sorbent pump 906 for pumping gases, a Blackberry 908 for processing and receiving/transmitting e-mails, etc., an optional cooling fan 910 for cooling the system, a battery 912 (or other suitable power supply), control electronics 914 which are designed such that the unit operates as described in this document, a spare sorbent tube holder 924, a primary sorbent tube holder 922, a multiRae 920, a light-weight chemical detector 1018 and a HAZMAT CAD 916. The multirae 920 is preferably a MultiRae Plus Photoionlonization detector (PID) by RAE Systems, Sunnyvale, Calif. The light weight chemical detector 918 preferably is preferably an "LCD3" by Smiths Detection, Pine Brook, N.J. which includes an Ion Mobility Spectrometer (IMS) and can simultaneously detect, identify and/or differentiate between different types of chemical warfare agents at below attack concentrations. The Hazmat CAD 916 sensor is preferably a HAZMAT CAD plus SAW sensor manufactured by Arrow-Tech, Inc., Rolla, N. Dak. which can detect and classify both chemical warfare and toxic industrial chemical agents.

Figure 10:
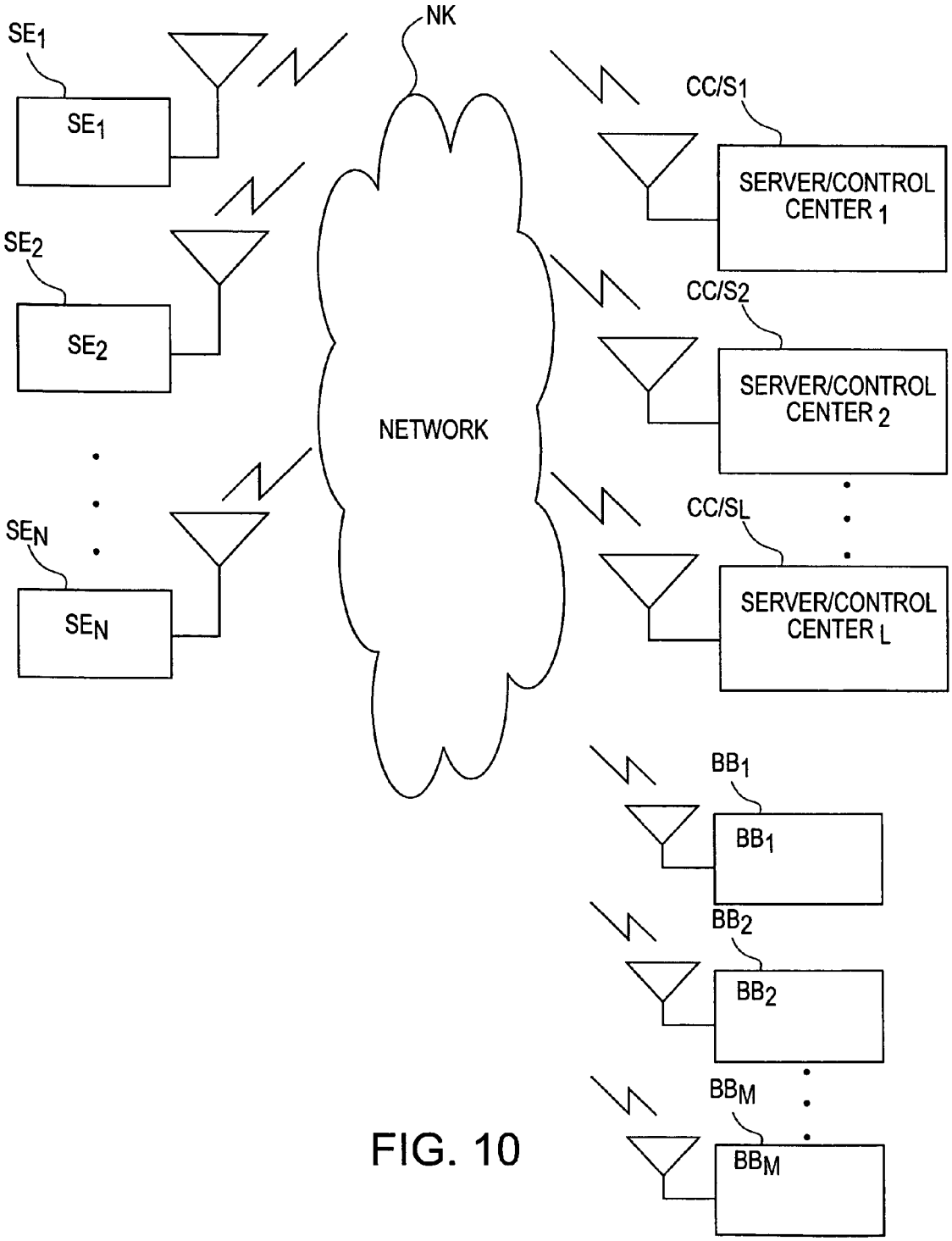
FIG. 10 is a block diagram illustrating a stackable configuration of the present invention.

A block diagram illustrating a stackable configuration of the present invention is shown in FIG. 10. A plurality of SEs ($SE_1$-$SE_N$) communicate with one or more control centers and/or e-mail servers $\mathbf{1006_1}$-$\mathbf{1006_o}$ and a plurality of users $\mathbf{1006_1}$-$\mathbf{1006_M}$. Although the control centers shown do not have to be integrated with the e-mail servers, for the sake of clarity they have been combined.

It is envisioned that many components for realizing the present invention are commercial off-the-shelf (COTS) units and therefore are readily available at low cost. The Blackberry used throughout the present invention is a, for example, Blackberry 950 model manufactured by Research In Motion (RIM).

While the present invention has been described in detail according to an environmental monitoring system, the present invention can also be used for controlling conditions at selected sites. Moreover, the present invention can be used for command and control of various systems, e.g., such as heating, ventilation, and air-conditioning (HVAC) and other building systems. Furthermore, the present invention can be used for authentication of environmental threats.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A monitoring system for detecting environmental conditions, comprising:

a sensing unit including one or more sensors for obtaining data related to environmental conditions, the one or more sensors including at least one of a radiation sensor, and first and second orthogonal chemical sensors that use dissimilar technologies to detect a chemical at dissimilar detection thresholds;

an air pump for providing air flow to at least one of the one or more sensors;

a controller interfaced with the sensing unit for receiving, interpreting and encoding the data related to environmental conditions into a predetermined format, wherein the controller determines whether to encode an alarm condition into the data in a predetermined format based on whether the first and the second chemical sensors both detect the chemical, and whether the first and second chemical sensors each detect the chemical for a predetermined duration of time; and a communication device including a display for receiving the data in a predetermined format from the controller, including the alarm condition, if present, forming an e-mail message and transmitting the e-mail message including the data in a predetermined format to at least one predetermined e-mail address.

2. The monitoring system of claim 1, wherein the one or more sensors further includes an imager.

3. The monitoring system of claim 1, further including a receiver, accessible via an e-mail address, for receiving an e-mail including at least one of a command and a query and providing the received command or query to the controller.

4. A monitoring system for detecting environmental conditions, comprising:

a sensing unit for obtaining data related to environmental conditions, the sensing unit including at least one radiation sensor, at least one of an electro-optical (EO), infrared, video or photographic imager, and a plurality of orthogonal chemical sensors that use dissimilar technologies to detect a chemical at dissimilar detection thresholds;

an air pump for providing air flow to at least one of the plurality of orthogonal sensors;

a controller interfaced with the sensing unit for receiving, interpreting and encoding the data related to environmental conditions into a predetermined format, wherein the controller determines whether to encode an alarm condition into the data in a predetermined format based on whether the first and the second chemical sensors both detect the chemical, and whether the first and second chemical sensors each detect the chemical for a predetermined duration of time; and a communication device including a display for receiving the data in a predetermined format from the controller, including the alarm condition, if present, forming an e-mail message and transmitting the e-mail message including the data in the predetermined format to at least one predetermined e-mail address.

5. The monitoring system of claim 4, further including a receiver for receiving an e-mail including at least one of a command and a query and providing the received command or query to the controller.

6. The monitoring system of claim 4, wherein the sensing unit includes sensors for detecting at least one of powders, explosives, nerve agents, blister agents, chemical agents, biological agents, and radioactive elements.

7. The monitoring system of claim 4, wherein the sensing unit further comprises at least one biological sensor.

8. The monitoring system of claim 7, wherein the EO imager comprises at least one of a visible light imager, an infra-red (IR) imager, a ultra-violet (UV) imager and an X-ray imager.

9. The monitoring system of claim 4, wherein a base64 encoding scheme is used for encoding the data related to environmental conditions.

10. The monitoring system of claim 4, wherein the encoded data comprises ASCII data including data related to environmental conditions, alerts, actions, triggers and/or results of the processing of the data related to environmental conditions.

11. The monitoring system of claim 4, wherein the encoded data includes information on how to decode the encoded data.

12. The monitoring system of claim 4, wherein the encoded data includes information on how to assemble the encoded data.

13. The monitoring system of claim 4, wherein the air pump when activated by the controller, pumps air through both a manifold and at least one sensor.

14. A method for detecting environmental conditions using a wireless device, the method comprising:

obtaining data related to environmental conditions, said obtaining including sensing radiation, sensing electro-optical (EO) images, and sensing a chemical using a plurality of orthogonal chemical sensors that use dissimilar technologies to detect a chemical at dissimilar detection thresholds;

determining whether an alarm condition exists based on whether each of the plurality of chemical sensors detects the chemical, and whether each of the plurality of chemical sensors detects the chemical for a predetermined duration of time;

encoding the obtained data related to environmental conditions, including encoding the alarm condition, if any into a predetermined format;

forming an e-mail message having a subject line and a body, the e-mail message including the data related to environmental conditions in the predetermined format; and transmitting the e-mail message including the data in the predetermined format to at least one predetermined e-mail address.

15. The method for detecting environmental conditions of claim 14, further comprising receiving at least one of a command and a query processing the received command and/or query.

16. The method for detecting environmental conditions of claim 14, wherein a base64 encoding scheme is used for encoding the data related to environmental conditions.

17. The method for detecting environmental conditions of claim 14, wherein the encoded data comprises ASCII data including data related to environmental conditions, alerts, actions, triggers and/or results of the processing of the data related to environmental conditions.

18. The method for detecting environmental conditions of claim 14, wherein the encoded data further includes information on how to decode and assemble the encoded data.

19. The method for detecting environmental conditions of claim 14, further comprising the step of capturing environmental samples using a sorbent tube.

20. A monitoring system for detecting environmental conditions comprising:

a plurality of sensors for obtaining data related to environmental conditions, the sensors including at least one radiation sensor, at least one of an electro-optical (EO) imager, and a plurality of orthogonal chemical sensors that use dissimilar technologies to detect a chemical at dissimilar detection thresholds;

a microcontroller interfaced with the plurality of sensors, the microcontroller forming a base64 encoded message including the data related to environmental conditions, wherein the microcontroller determines whether to encode an alarm condition into the encoded data based on whether each of the plurality of chemical sensors detects the chemical, and whether each of the plurality of chemical sensors detects the chemical for a predetermined duration of time; and a transmitter interfaced with the microcontroller for transmitting the encoded data, including the alarm condition, if any, to at least one predetermined e-mail address.

21. The monitoring system of claim 20, further including a receiver for receiving a command and/or a query and providing the received command and/or query to the microcontroller for decoding of the received command and/or query.

22. The monitoring system of claim 20, wherein the plurality of sensors includes at least two orthogonal sensors capable of detecting at least one element selected from the group comprising powders, explosives, nerve agents, chemicals, biological agents, and radioactive elements.

23. The monitoring system of claim 20, wherein the sensing unit further comprises one or more biological sensors.

24. The monitoring system of claim 23, wherein the EO imager comprises at least one of a visible light imager, an infra-red (IR) imager, a ultra-violet (UV) imager and an X-ray imager.

25. The monitoring system of claim 20, wherein the encoded data comprises ASCII data including data related to environmental conditions, alerts, actions, triggers and/or results of the processing of the data related to environmental conditions.

26. The monitoring system of claim 20, wherein the encoded base64 message further includes information on how to decode and/or assemble the base64 message.

27. The monitoring system of claim 1, wherein:

the first chemical sensor has a first detection threshold;

the second chemical sensor has a second detection threshold that is less than the first detection threshold, and the controller encodes the alarm condition when the first chemical sensor and the second chemical sensor both detect the chemical, but the second chemical sensor fails to detect the chemical for the predetermined duration of time.

28. The monitoring system of claim 27, wherein the controller does not encode the alarm condition when the first chemical sensor and the second chemical sensor both detect the chemical, but the first chemical sensor fails to detect the chemical for the predetermined duration of time.

* * * * *